US008603200B2

(12) United States Patent
Aradi et al.

(10) Patent No.: US 8,603,200 B2
(45) Date of Patent: Dec. 10, 2013

(54) COMPOSITIONS COMPRISING COMBUSTION IMPROVERS AND METHODS OF USE THEREOF

(75) Inventors: Allen A. Aradi, Glen Allen, VA (US); Joseph W. Roos, Mechanicsville, VA (US)

(73) Assignee: Afton Chemical Corporation, Richmond, VA (US)

( * ) Notice: Subject to any disclaimer, the term of this patent is extended or adjusted under 35 U.S.C. 154(b) by 809 days.

(21) Appl. No.: 12/488,994

(22) Filed: Jun. 22, 2009

(65) Prior Publication Data

US 2010/0319243 A1 Dec. 23, 2010

(51) Int. Cl.
*C10L 1/23* (2006.01)
*C10L 1/22* (2006.01)

(52) U.S. Cl.
USPC ..... 44/413; 44/414; 44/354

(58) Field of Classification Search
USPC ..... 44/412–414, 350, 603, 354
See application file for complete search history.

(56) References Cited

U.S. PATENT DOCUMENTS

| | | | | |
|---|---|---|---|---|
| 1,741,206 | A | 12/1929 | Stackhouse | |
| 2,051,873 | A | 8/1936 | Lowry, Jr. | |
| 2,061,627 | A * | 11/1936 | Hodgson | 564/413 |
| 2,618,538 | A * | 11/1952 | Robertson et al. | 44/322 |
| 2,759,804 | A | 8/1956 | Sherman | |
| 2,962,365 | A | 11/1960 | Kolfenbach et al. | |
| 3,294,814 | A * | 12/1966 | Reicheneder et al. | 548/372.1 |
| 3,434,814 | A * | 3/1969 | Dubeck et al. | 44/399 |
| 4,772,473 | A * | 9/1988 | Patel et al. | 424/457 |
| 5,925,152 | A * | 7/1999 | Barratt et al. | 44/350 |
| 2003/0164147 | A1 | 9/2003 | Duncan et al. | |
| 2004/0237383 | A1 * | 12/2004 | Daly et al. | 44/301 |
| 2004/0237384 | A1 | 12/2004 | Orr | |

FOREIGN PATENT DOCUMENTS

| | | |
|---|---|---|
| DE | 164634 | 10/1905 |
| EP | 420581 | 4/1991 |
| EP | 0879871 | 11/1998 |
| FR | 496099 | 10/1919 |
| GB | 131769 | 9/1919 |
| GB | 347132 | 4/1931 |
| GB | 501844 | 3/1939 |
| GB | 599132 | 3/1948 |
| GB | 673125 | 6/1952 |
| GB | 697730 | 9/1953 |
| GB | 1574297 | 9/1980 |

OTHER PUBLICATIONS

Ind. Eng. Chem. Res.: Application of Transistion State Theory for Thermal Stability Prediction Ind. Eng. Chem. Res. 2003, 42, 1341-1346 by SR Saraf, WJ Rogers and M.S. Mannan at Table 2 p. 1344.*
European Search Report, EPO Application No. 10251114, EPO, Dec. 6, 2010.

(Continued)

*Primary Examiner* — Pamela H Weiss
(74) *Attorney, Agent, or Firm* — Novak Druce Connolly Bove + Quigg LLP

(57) ABSTRACT

The present disclosure relates to a gasoline combustion improver comprising an organic nitro compound with C—$NO_2$ bond dissociation energy of about 60 to about 80 Kcal/mol of compound, wherein the organic nitro compound is selected from the group consisting of nitro-aromatics, heteroatom aromatic ring compounds, heteroatom nonaromatic ring compounds, and nitrated furfuryls, and wherein the organic nitro compound is not nitrotoluene or dinitrotoluene.

19 Claims, 2 Drawing Sheets

(56) References Cited

OTHER PUBLICATIONS

Peter Politzer et al., C—NO2 Dissociation Energies and Surface Electrostatic Potential Maxima in Relation to the Impact Sensitivities of Some Nitroheterocyclic Molecules, New Orlean University La Dept of Chemistry Technical Report, Mar. 27, 1995, pp. 1-7, New Orleans, LA, U.S.A. Retrieved from the Internet: URL: http://handle.dtic.mil/100.2/ADA292004 [retrieved on Oct. 14, 2010].

J. Shao et al., The C—NO2 Bond Dissotion Energies of Some Nitroaromatic Compounds: DFT Study, Structrual Chemistry, vol. 17, No. 5, Sep. 7, 2006, pp. 547-550, People's Republic of China.

B.M. Rice et al., Density Functional Calculations of Bond Dissociation Energies for NO2 Scission in Some Nitroaromatic Molecules, Journal of Molecular Strucutre: Theochem, vol. 583, Apr. 19, 2002, pp. 69-72, U.S.A.

Singapore Search Report, Singapore Patent Application No. 201003495-7, Intellectual Property Office of Singapore, Feb. 15, 2011.

* cited by examiner

COMPOSITIONS COMPRISING COMBUSTION IMPROVERS AND METHODS OF USE THEREOF

FIELD OF THE DISCLOSURE

The present disclosure relates in one embodiment to a gasoline combustion improver comprising an organic nitro compound with C—$NO_2$ bond dissociation energy ranging from about 60 to about 80 Kcal/mol of compound, wherein the organic nitro compound is selected from the group consisting of nitro-aromatics, heteroatom (N, O) aromatic ring compounds, heteroatom nonaromatic ring compounds, and nitrated furfuryls.

BACKGROUND OF THE DISCLOSURE

Organic nitrates and organic nitro compounds have been added to diesel fuels, as cetane improvers, for years. Since the 1930's, organic nitrates have been used in diesel fuels to increase cetane number and thereby achieve a level of auto-ignition sufficient to allow the operation of the diesel engine.

It has been discovered that the use of organic nitrogen-containing compounds selected from organic nitrates and/or organic nitro compounds, in gasoline, at specific treat rates, results in improved ignition properties and therefore benefits fuel economy, cold start ignition, lean burn, and reduced emissions. Improved ignition properties are evidenced by the reduction or complete elimination of engine misfires. The addition of organic nitrogen oxide containing compounds typically thought of as cetane improvers to gasoline appears counterintuitive. Because additives which increase the cetane number of diesel fuels are known to be pro-knock agents when added to gasoline, the discovery that the addition of an organic nitrate compound or an organic nitro compound to gasoline, at specific treat rates, will not negatively affect fuel octane and at the same time will improve the ignition properties of the fuel is surprising.

Cetane improver fuel additives, such as 2-ethylhexyl nitrate and di-tert-butyl peroxide, function at low temperatures (550-700K) of the internal combustion engine combustion cycle by promoting radical generation forcing ignition. The peak performance temperature regime of cetane improvers is centered around 625 degrees K. (about 352 C), above which all the —$NO_2$ is used up and the additives are transformed to hydrocarbon fragments with similar combustion characteristics as the base fuel. Therefore development of combustion improvers that survive to higher temperatures in the combustion cycle of an internal combustion engine would contribute to more efficient combustion with predicable rates. Predictable fuel combustion efficiency can be manipulated to yield more power, torque, thermal efficiency, fuel economy, and lowered emissions. The major challenge in developing these additives is the fact that almost all organics begin thermal decomposition at about 673 degrees K. (400 C). This is close to the ignition point (about 800K, or 527 C) of fuel/air charge in internal combustion engines. Therefore, for an organic additive to function in the entire combustion regime of the engine, it has to survive at least up to 800 K.

What is needed is a gasoline combustion improver with a sufficiently high enough bond dissociation energy so that it will not dissociate at the low temperatures (550-700 degrees K.) of the internal combustion engine.

BRIEF DESCRIPTION OF THE DRAWINGS

The accompanying drawings, which are incorporated in and constitute a part of this specification, illustrate certain embodiments of the invention and together with the description, serve to explain the principles of the invention. In the figures.

SUMMARY OF THE DISCLOSURE

Figure 1:
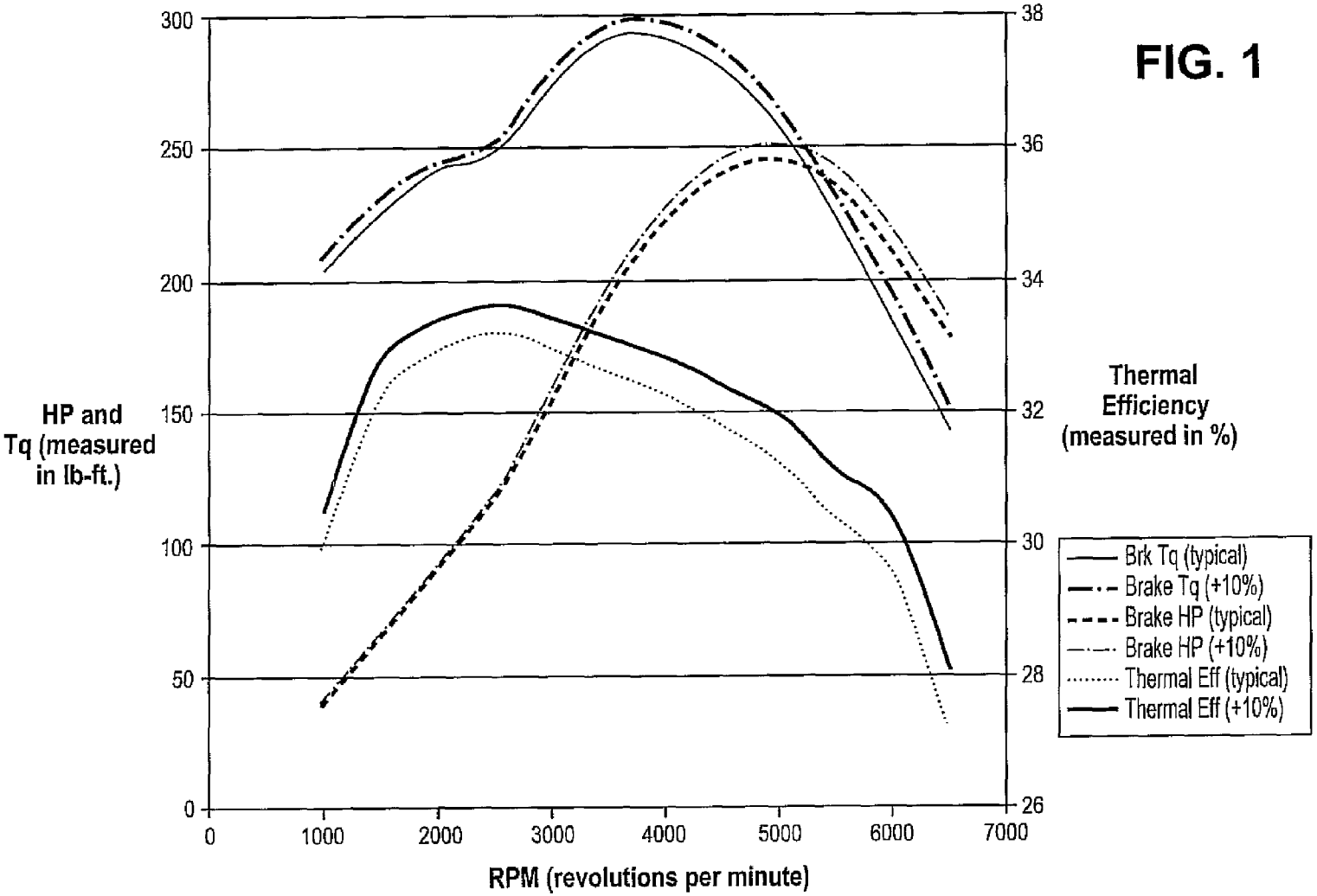
FIG. 1 is a graph illustrating engine performance for typical gasoline fuel and typical gasoline fuel containing inventive combustion improver additive providing 10% increased burn rate.

In accordance with the disclosure, there is disclosed a gasoline combustion improver comprising an organic nitro compound with C—$NO_2$ bond dissociation energy of about 60 to about 80 Kcal/mol of compound, wherein the organic nitro compound is selected from the group consisting of nitro-aromatics, heteroatom aromatic ring compounds, heteroatom nonaromatic ring compounds, and nitrated furfuryls.

DESCRIPTION OF THE EMBODIMENTS

The present disclosure relates in one embodiment to a gasoline combustion improver comprising an organic nitro compound with C—$NO_2$ bond dissociation energy ranging from about 60 to about 80 Kcal/mol of compound. In another embodiment the organic nitro compound is selected from the group consisting of nitro-aromatics, nitrated heteroatom (N, O) aromatic ring compounds, nitro-heteroatom nonaromatic ring compounds, and nitrated furfuryls. The organic nitro compounds do not include nitromethanes, alkyl nitrates or aliphatic amines. Moreover, the organic nitro compounds are not nitrotoluene or dinitrotoluene.

The combustion improver disclosed herein should have a C—$NO_2$ bond dissociation energy of about 65 to 80 Kcal/mol of compound. In an aspect, the bond dissociation energy ranges from about 60 to about 75, and for example is about 70, Kcal/mol of compound. With this knowledge, one can create additional combustion improvers through numerical calculations of the respective C—$NO_2$ bond dissociation energies (BDEs) of a chosen —C—$NO_2$ platform structure. Then, by selecting positional isomerization of —$NO_2$ on the chosen platform carrier, and also selecting suitable substituents to the platform structure, such as a balancing of electron-releasing versus electron-withdrawing substitutents, one can arrive at the ideal final molecule with a —C—$NO_2$ BDE of about 70 Kcal/mole.

The nitro-aromatics include, but are not limited to, aromatics such as benzene, and fused and nonfused aromatic rings, for example naphthalenes, anthracenes, phenanthrenes, biphenyl and hydrocarbon substituted biphenyls, triphenyls, and etc.

Furan nitro derivatives include, but are not limited to, furazolidone, nitrofurantoin, nitrofurazone, nitrofurfuryl alcohol, and nitrofuraldehyde.

Amine substituents include, but are not limited to, nitroanilines, N-alkyl nitroanilines, nitrophenylhydrazines, alkyl nitroanilines, N-alkyl nitroanilines, alkoxylnitroanilines(nitroanisoles), N-alkyl alkoxylnitroanilines, nitroindolenes, nitronaphthylamines, nitrocarbazoles, and nitrobenzimidazoles.

Heteroarenes include, but are not limited to, 3-Nitro-2,6-lutidines, nitropyrazoles, and nitrotriazoles.

Additional non-limiting examples of organic nitro compounds for use in the present disclosure are nitrobenzo-18-crown-6, nitrobenzophenone, nitrobenzoxazole-2(3H)-one, and nitrocinnamaldehyde.

In an aspect, the combustion improver is a non-gaseous and gasoline-soluble nitro-compound. One of ordinary skill in the art would understand that by "non-gaseous" it means that the combustion improver is a liquid below about 293 degrees K. However, for most effective transportation of the combustion improver from the fuel liquid phase to the gas phase in the engine, it has to boil above the T50 of the fuel, the temperature at which 50% of the fuel has vaporized. For gasoline, T50 is typically ~120° C., (393 K), which is above the boiling point of nitromethane (101.2° C.).

In another aspect, the nitro group, of the organic nitro compound, is on the aromatic ring. In another aspect, the nitro group is not on the aromatic ring, such as in heteroatom nonaromatic ring compounds.

The organic nitro compound for use in the present disclosure can also be selected from the group consisting of N-alkyl nitroaniline; alkyl nitroanisole; nitrofurfuryl nitrate; alkyl nitrophenol; N,N-dialkyl nitroaniline; and alkyl nitrobenzene. In particular, the organic nitro compound should comprise electron releasing groups, which will help push electrons into the aromatic ring in order to obtain the disclosed bond dissociation energy. Non-limiting examples of electron releasing groups include alkyl groups, methoxy groups, amine groups, and alkoxy groups.

The C—$NO_2$ bond of the organic nitro compound should not dissociate in a combustion chamber at a temperature below about 750 degrees Kelvin. The combustion chamber can be a spark-ignited internal combustion engine. By "high temperature" herein is meant a temperature above about 750 degrees Kelvin.

In an aspect, there is disclosed a gasoline composition comprising a gasoline and the disclosed gasoline combustion improver. The combustion improver can be present in the composition in an amount ranging up to about 25,000 ppm by weight. Moreover, the combustion improver can be present in the composition in an amount ranging from about 1000 to about 3000 ppm by weight.

The gasolines utilized in the practice of this disclosure can be traditional blends or mixtures of hydrocarbons in the gasoline boiling range, or they can contain oxygenated blending components such as alcohols and/or ethers having suitable boiling temperatures and appropriate fuel solubility, such as methanol, ethanol, methyl tert-butyl ether (MTBE), ethyl tert-butyl ether (ETBE), tert-amyl methyl ether (TAME), and mixed oxygen-containing products formed by "oxygenating" gasolines and/or olefinic hydrocarbons falling in the gasoline boiling range. Thus this disclosure involves use of gasolines, including the so-called reformulated gasolines which are designed to satisfy various governmental regulations concerning composition of the base fuel itself componentry used in the fuel, performance criteria, toxicological considerations and/or environmental considerations. The amounts of oxygenated components, detergents, antioxidants, demulsifiers, and the like that are used in the fuels can thus be varied to satisfy any applicable government regulations, provided that in so doing the amounts used do not materially impair the improved ignition performance made possible by the practice of this invention.

While not required for the purpose of this invention, the gasoline compositions of this disclosure can include other additives such as one or more detergents, antioxidants, demulsifiers, corrosion inhibitors and/or metal deactivators.

All combustion improving additives of this disclosure should have a boiling point above the maximum T50 of gasoline (~120° C., or 393 K). T50 is the temperature at which 50% of the gasoline has vaporized. This is important for high temperature combustion improvers because it ensures they are not prematurely vaporized into gas phase feeding the flame front during the engine combustion cycle.

Moreover, there is disclosed a method to improve gasoline combustion efficiency, said method comprising adding to a gasoline to be combusted a gasoline combustion improver as disclosed herein to form a gasoline composition, then combusting said gasoline composition. In addition, there is disclosed a method to improve power yield from the combustion of a gasoline composition, said method comprising adding to a gasoline to be combusted a gasoline combustion improver as disclosed herein to form a gasoline composition, then combusting said gasoline composition.

In an aspect, there is disclosed a method to improve gasoline economy from the combustion of a gasoline composition, said method comprising adding to a gasoline to be combusted a gasoline combustion improver as disclosed herein to form a gasoline composition, then combusting said gasoline composition to give improved burn rates leading to increased power, torque, and thermal efficiency. Power and torque are interconvertible with fuel economy.

In another aspect, there is disclosed a method to reduce emissions from the combustion of a gasoline composition, said method comprising adding to a gasoline to be combusted a gasoline combustion improver as disclosed herein to form a gasoline composition, then combusting said gasoline composition. Improved burn rates lead to more complete and efficient combustion leading to lowered emissions. The emissions reduced are selected from the group consisting of particulate matter, $NO_x$, and hydrocarbons, and further wherein the production of $CO_2$ and water are increased.

A method to increase the rate of high temperature combustion of a base gasoline is disclosed, the method comprising adding to a base gasoline to be combusted a gasoline combustion improver as disclosed herein to form a gasoline composition, then combusting said gasoline composition, whereby the rate of combustion of the base gasoline in the temperature range 800-1025 degrees K. is increased.

Additional methods include, a method for improving the ignition properties of a spark-ignition internal combustion engine, method of reducing misfire in a spark-ignition internal combustion engine, method of preventing partial combustion in a spark-ignition internal combustion engine, and/or method of improving cycle-to-cycle variation in a spark-ignition internal combustion engine; wherein the methods comprise adding to and combusting in said engine a gasoline composition as disclosed herein.

EXAMPLES

The following examples further illustrate aspects of the present disclosure but do not limit the present disclosure.

Combustion testing will reveal that organic nitro compounds with C—$NO_2$ bond dissociation energies (BDEs) of about 70 Kcal/mol are viable high temperature combustion improvers. Aryl-aromatics and furfuryls provide quite suitable platform carriers of pertinent —$NO_2$ functional group(s). The oxidation of gasoline can be, for example, studied at 10 atm, and in the temperature range 560-1030 degrees K. at three different equivalence ratios ($\phi$=0.5, 1, and 2). The reacting mixtures can be, in one aspect, highly diluted by nitrogen and the percentage of carbon injected in the test equal to 1%, which corresponds to an initial fuel mole fraction of $7\times10^{-4}$.

Example 1

Flame burn rates of fuels may be determined by several methods, two of which are; 1) stagnation (opposed-jet) flat flame, and 2) constant volume combustion apparatus (CVCA) or combustion bomb. Both methods adopt different degrees of sophistication in optics to achieve the measurements.

One could use the stagnation flat flame method coupled with laser diagnostics to measure the flame speeds of a base fuel, and that base fuel additized with 2000 mg/L oft for example, the five additives listed below:

N-Methyl-2-nitroaniline,
Nitrocyclohexane,
4-Methyl-2-nitrophenol,
4-Methyl-2-nitroanisole, and
5-Nitrofurfuryinitrate.

Figure 2:
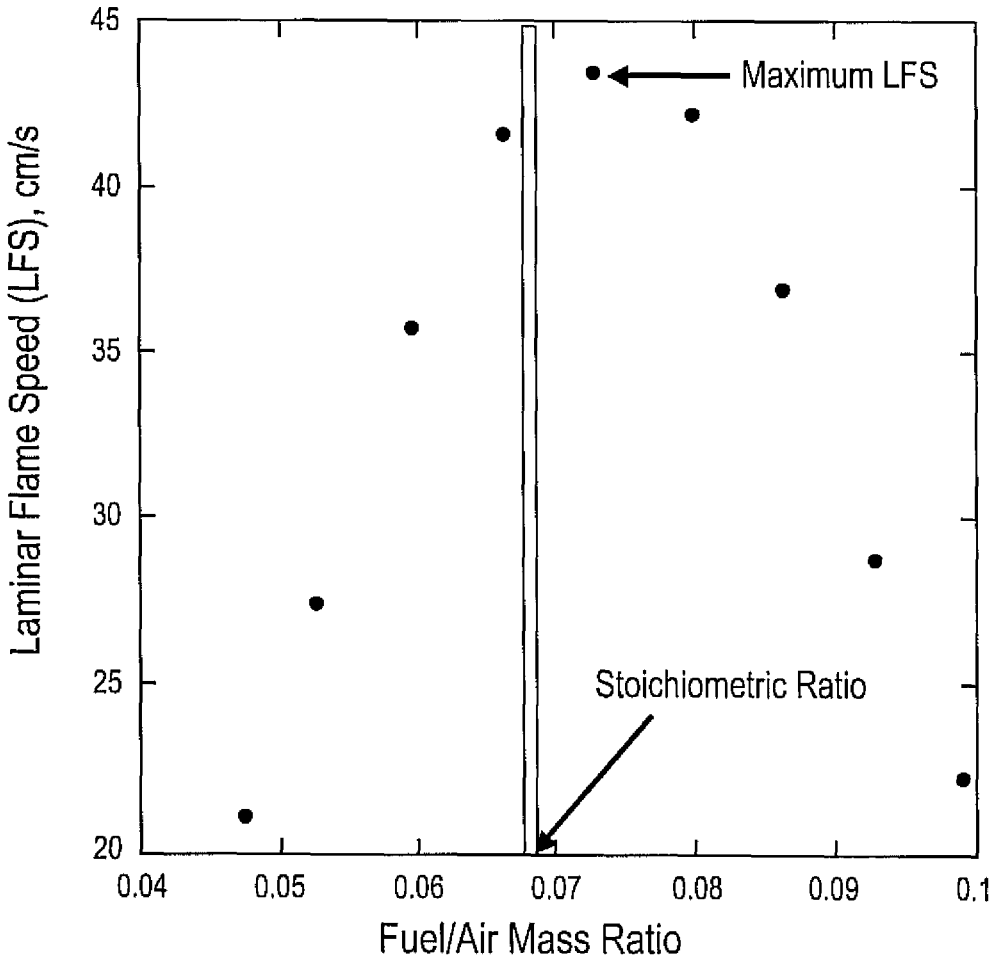
FIG. 2 illustrates the fuel laminar flame speed (LSF) determination by the stagnation flat flame method.

The measurements can be made at intervals across the equivalence ratios from lean to rich (i.e. 0.04-0.1 Fuel/Air Mass Ratios illustrated in FIG. 2). This range reflects equivalence ratios from 0.6 (very lean) to 1.6 (very rich). Equivalence ratio is often abbreviated as "phi" or "ϕ". As FIG. 2 shows, this range of measurements can be made for each fuel to give the dome shaped plot from which the characteristic maximum laminar flame speed (LFS) can be determined. The LFSs for the additized fuels can then be compared with that of the base fuels and the differences calculated as a percent change in burn rates. The expected burn rates from the base fuel additized with the disclosed combustion improvers can show improvements of up to 15%. To translate these burn rate improvements to engine performance improvements, there are various engine design models that can be used to calculate corresponding increases in horse power (HP), Torque (Tq), Thermal Efficiency (TE), etc.

Example 2

The model used here was for a Ford 8 cylinder engine. The results for a 10% improvement in burn rate are plotted in FIG. 1. The test was conducted at wide open throttle and 12.5 air to fuel ratio using a 4.6 L Ford V8 engine and comparing the brake torque, brake horsepower and thermal efficiency. Fuel flow and spark timing were held constant.

At typical vehicle operating conditions, such as 2000 rpm, horse power and torque improve by about 1.5%. Thermal efficiency also improves by about 1.2%. At higher speeds and load, the numbers improve to 1.8% (Tq), 2.3% (HP), and 2.1% (Thermal Efficiency), respectively. Using a base fuel and a base fuel containing additive with a 10% higher burn rate, increases in combustion rate, horsepower, torque and combustion efficiency were observed in the case of the additized fuel, as shown in FIG. 1.

The model calculated these results based on the same fuel consumption with base fuel and base fuel plus respective additive giving a burn rate improvement of 10%. The benefits in power, torque and thermal efficiency can be traded off for fuel economy, if that is what is desired. Faster burn rates are particularly beneficial at high engine speeds, because as engine speed increases the fuel has less time to burn before the exhaust valve opens. Therefore one would expect hydrocarbon (HC) and CO emissions to increase with engine speed because the combustion charge in the cylinder has increasingly less time to burn before being exhausted. The disclosed additives would mitigate this problem leading to a decrease in expected emissions.

It is expected that these performances can be further improved by optimizing structural groups in additive molecules that promote these performances.

At numerous places throughout this specification, reference has been made to a number of U.S. patents, published foreign patent applications and published technical papers. All such cited documents are expressly incorporated in full into this disclosure as if fully set forth herein.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

What is claimed is:

1. A gasoline composition comprising:
a gasoline; and
a gasoline combustion improver comprising:
an organic nitro compound with C—$NO_2$ bond dissociation enemy of about 60 to about 80 Kcal/mol of compound,
wherein the organic nitro compound is selected from the group consisting of alkyl nitroanisole, nitrofurfuryl nitrate, N,N-dialkyl nitroaniline, furazolidone, nitrofurantoin, nitrofurazone, nitrofurfuryl alcohol, nitrofuraldehyde,-nitrophenylhydrazines, alkoxylnitroanilines (nitroanisoles), N-alkyl alkoxylnitroanilines, nitroindolenes, nitronaphthylamines, nitrocarbazoles, nitrobenzimidazoles, 3-Nitro-2,6-lutidines, nitropyrazoles, nitrotriazoles, nitrobenzo-18-crown-6, nitrobenzophenone, nitrobenzoxazole-2(3H)-one, and nitrocinnamaldehyde, and
wherein the organic nitro compound is not nitrotoluene or dinitrotoluene.

2. The combustion improver of claim 1, wherein the organic nitro compound has a boiling point above the T50 of gasoline.

3. The combustion improver of claim 1, wherein the bond dissociation energy is about 65 to 75 Kcal/mol of compound.

4. The combustion improver of claim 1, wherein the bond dissociation energy is about 70 Kcal/mol of compound.

5. The combustion improver of claim 1, wherein the nitro group is on the aromatic ring.

6. The combustion improver of claim 1, wherein the C—$NO_2$ bond of the organic nitro compound does not dissociate in a combustion chamber at a temperature below about 750 degrees Kelvin.

7. The combustion improver of claim 5, wherein the combustion chamber is a spark-ignited internal combustion engine.

8. The gasoline composition of claim 1, wherein the combustion improver is present in the composition in an amount ranging up to about 25,000 ppm by weight.

9. The gasoline composition of claim 1, wherein the combustion improver is present in the composition in an amount ranging from about 1000 to about 3000 ppm by weight.

10. A method to improve gasoline combustion efficiency, said method comprising combusting said gasoline composition of claim 1 in an internal combustion engine.

11. A method to improve power yield from the combustion of a gasoline composition, said method comprising combusting said gasoline composition of claim 1 in an internal combustion engine.

12. A method to improve gasoline economy from the combustion of a gasoline composition, said method combusting said gasoline composition of claim 1 in an internal combustion engine.

13. A method to reduce emissions from the combustion of a gasoline composition, said method comprising combusting said gasoline composition of claim 1 in an internal combustion engine.

14. The method of claim 13, wherein the emissions reduced are selected from the group consisting of particulate matter, $NO_x$, and hydrocarbons, and further wherein the production of $CO_2$ and water are increased.

15. A method to increase the rate of high temperature combustion of a base gasoline, comprising combusting said gasoline composition of claim 1, whereby the rate of combustion of the base gasoline in the temperature range 800-1025 K is increased.

16. A method for improving the ignition properties of a spark-ignition internal combustion engine, wherein said method comprises adding to and combusting in said engine a gasoline composition according to claim 1.

17. A method of reducing misfire in a spark-ignition internal combustion engine, wherein said method comprises adding to and combusting in said engine a gasoline composition according to claim 1.

18. A method of preventing partial combustion in a spark-ignition internal combustion engine, wherein said method comprises adding to and combusting in said engine a gasoline composition according to claim 1.

19. A method of improving cycle-to-cycle variation in a spark-ignition internal combustion engine, wherein said method comprises adding to and combusting in said engine a gasoline composition according to claim 1.

* * * * *